US012035813B2

(12) United States Patent
Fukuyama et al.

(10) Patent No.: US 12,035,813 B2
(45) Date of Patent: Jul. 16, 2024

(54) SLEEPING EQUIPMENT

(71) Applicants: TOYOTA JIDOSHA KABUSHIKI KAISHA, Aichi-ken (JP); TOYOTA BOSHOKU KABUSHIKI KAISHA, Aichi-ken (JP)

(72) Inventors: Gen Fukuyama, Nagoya (JP); Mikio Inoue, Nagoya (JP); Reiko Yamamato, Anjyo (JP); Hayato Wakatsuki, Anjo (JP); Tsutomu Hanase, Kariya (JP); Shigeki Tanaka, Nagoya (JP)

(73) Assignees: TOYOTA JIDOSHA KABUSHIKI KAISHA, Aichi-Ken (JP); TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/525,965

(22) Filed: Nov. 15, 2021

(65) Prior Publication Data

US 2022/0167755 A1 Jun. 2, 2022

(30) Foreign Application Priority Data

Nov. 30, 2020 (JP) ..... 2020-198995

(51) Int. Cl.
*A47C 27/10* (2006.01)
*A47C 17/04* (2006.01)
*A47C 17/80* (2006.01)

(52) U.S. Cl.
CPC ..... *A47C 27/10* (2013.01); *A47C 17/04* (2013.01); *A47C 17/80* (2013.01)

(58) Field of Classification Search
CPC ..... A47C 27/08; A47C 27/081; A47C 27/082; A47C 27/083; A47C 27/087; A47C 27/10; A47C 17/04; A47C 17/80
See application file for complete search history.

(56) References Cited

U.S. PATENT DOCUMENTS 4,965,901 A * 10/1990 Normand ..... A47C 27/128 5/710
5,121,961 A * 6/1992 Marshall ..... A47C 7/622 297/284.3
5,787,531 A * 8/1998 Pepe ..... A47C 27/081 5/710

(Continued)

FOREIGN PATENT DOCUMENTS

JP S63-222711 A 9/1988
JP 2004229966 A 8/2004

(Continued)

*Primary Examiner* — Justin C Mikowski
*Assistant Examiner* — George Sun
(74) *Attorney, Agent, or Firm* — HAUPTMAN HAM, LLP

(57) ABSTRACT

Sleeping equipment includes a mat body and a plurality of air bags. The mat body includes a middle support portion, an upper support portion, and a lower support portion. The mat body is configured to switch between a bed mode and a chair mode. The air bags are arranged in the mat body in a mat length direction from the upper support portion toward the lower support portion. At least a part of the air bags is divided into right and left bag portions in a mat width direction, and the right bag portion and the left bag portion are configured to be independently inflated and deflated.

11 Claims, 9 Drawing Sheets

(56) References Cited

U.S. PATENT DOCUMENTS 6,212,719 B1 * 4/2001 Thomas ..... A47C 27/081 601/149
6,370,716 B1 * 4/2002 Wilkinson ..... A61G 5/1043 297/452.41
9,756,955 B2 * 9/2017 Alder ..... A47C 27/081
10,314,407 B1 * 6/2019 Main ..... A61B 5/1036
10,347,110 B1 * 7/2019 Li ..... G08B 21/0461
2003/0208848 A1 * 11/2003 Flick ..... A61G 7/05769 5/713
2004/0128772 A1 * 7/2004 Branson ..... A61G 7/05776 5/713
2005/0268401 A1 * 12/2005 Dixon ..... A61B 5/1115 5/713
2005/0278861 A1 * 12/2005 Kasatshko ..... A47C 27/082 5/713
2007/0143928 A1 * 6/2007 Biggie ..... A61G 7/0525 5/713
2011/0047703 A1 * 3/2011 Tarsaud ..... A61G 7/1021 5/607
2012/0124744 A1 * 5/2012 Hornbach ..... A61G 7/16 5/613
2013/0019408 A1 * 1/2013 Jacofsky ..... A61B 5/447 5/613
2013/0145558 A1 * 6/2013 Bhai ..... A61G 7/05 5/710
2013/0285426 A1 * 10/2013 Arant ..... B60N 2/914 297/452.48
2014/0210250 A1 * 7/2014 DiFelice ..... A61G 5/1045 297/452.48
2015/0101126 A1 * 4/2015 Reiners ..... A61G 7/1023 5/715
2015/0164720 A1 * 6/2015 Gibson ..... A61G 7/05769 5/83.1
2017/0000685 A1 * 1/2017 Rohr ..... A47C 21/006
2017/0202364 A1 * 7/2017 Ohno ..... A61G 7/057
2017/0202719 A1 * 7/2017 Ohno ..... A47C 27/10
2017/0332802 A1 * 11/2017 Stern ..... A61G 7/05769
2018/0105076 A1 * 4/2018 Dry ..... B60N 2/0248
2018/0178698 A1 * 6/2018 Izukawa ..... B60N 2/0268
2019/0174931 A1 * 6/2019 Ohno ..... A47C 27/082
2019/0380504 A1 * 12/2019 Therkildsen ..... A47G 9/1027
2020/0078241 A1 * 3/2020 Chang ..... A47C 27/082
2021/0338153 A1 * 11/2021 Barrera ..... A61B 5/14503
2021/0369191 A1 * 12/2021 Gill ..... A61B 5/0205
2021/0378413 A1 * 12/2021 Ohno ..... A61G 7/015

FOREIGN PATENT DOCUMENTS

JP 2006297056 A 11/2006
JP 2018-057902 A 4/2018
TW M276500 U 10/2005
WO 2014/035792 A1 3/2014

* cited by examiner

FIG. 7

| | DESIRED DISTRIBUTION RATE [%] | NO AIR [%] | AIR FILLED [%] |
|---|---|---|---|
| HEAD | 8 | 9.1 | 5.5 |
| CHEST | 33 | 35.7 | 38.9 |
| BUTTOCKS | 44 | 41.1 | 42.8 |
| LOWER LEGS | 15 | 16.9 | 12.9 |

FIG. 8

| | DESIRED DISTRIBUTION RATE [%] | NO AIR [%] | AIR FILLED [%] |
|---|---|---|---|
| HEAD | 8 | 5.8 | 4.1 |
| CHEST | 33 | 37.7 | 43.1 |
| BUTTOCKS | 44 | 47.7 | 41.4 |
| LOWER LEGS | 15 | 8.8 | 11.3 |

SLEEPING EQUIPMENT

CROSS-REFERENCE TO RELATED APPLICATION

This application claims priority to Japanese Patent Application No. 2020-198995 filed on Nov. 30, 2020, incorporated herein by reference in its entirety.

BACKGROUND

1. Technical Field

The present disclosure relates to sleeping equipment.

2. Description of Related Art

In Japanese Unexamined Patent Application Publication No. 2004-229966 (JP 2004-229966 A), a plurality of air cells is arranged in the longitudinal direction of an air mat, and the body pressure applied from the air mat to a user (sleeper) is dispersed by alternately inflating and deflating adjacent air cells.

SUMMARY

In the technique described in JP 2004-229966 A, each air cell has a tubular shape that is long in the lateral direction of the air mat. Accordingly, the pressure cannot be varied between the right and left sides in the lateral direction of the air mat. Comfort level may therefore be reduced when the user is in such a posture that the body pressure is different between the right and left sides of the user's body. The above technique has room for improvement in this respect.

The present disclosure provides sleeping equipment that can enhance the body pressure dispersion effect even when a user is in such a posture that the body pressure is different between the right and left sides of his or her body.

Sleeping equipment according to one aspect of the present disclosure includes a mat body and a plurality of air bags. The mat body includes a middle support portion configured to support buttocks and thighs of a user, an upper support portion configured to support a back and head of the user, and a lower support portion configured to support lower legs of the user. The mat body is configured to switch between a bed mode and a chair mode, the bed mode being a mode in which the mat body supports the user lying on the user's back on the mat body, and the chair mode being a mode in which the mat body supports the user sitting on the mat body. The air bags are arranged in the mat body in a mat length direction from the upper support portion toward the lower support portion. The air bags are in an elongated shape that is long in a mat width direction. At least a part of the air bags is divided into right and left bag portions in the mat width direction, and the right bag portion and the left bag portion are configured to be independently inflated and deflated.

According to the above aspect, the mat body includes the middle support portion, the upper support portion, and the lower support portion. The mat body is configured to switch between the bed mode and the chair mode. In the bed mode, the mat body supports the user lying on his or her back on the mat body. In the chair mode, the mat body supports the user sitting on the mat body. The user can thus switch from a sleeping posture to a sitting posture by switching the mode of the mat body.

The air bags are arranged in the mat body in the mat length direction from the upper support portion toward the lower support portion. These air bags are in the shape of an elongated bag that is long in the mat width direction, and can be inflated or deflated to disperse the body pressure applied from the mat body to the user. At least a part of the air bags is divided into the right and left bag portions in the mat width direction, and the right and left bag portions can be inflated and deflated independently. Accordingly, even when the user is in a posture biased toward one side in the mat width direction of the mat body, the body pressures applied from the mat body to the right and left sides of the body of the user can be adjusted by adjusting the right and left bag portions of the air bags independently. As a result, the body pressure dispersion effect can be enhanced even when the user is in such a posture that the body pressure is different between the right and left sides of the body.

In the above aspect, in at least the part of the air bags, the right bag portion and the left bag portion may be configured to be alternately inflated and deflated.

According to the above configuration, in the air bag divided into the right and left bag portions in the mat width direction, the right and left bag portions can be alternately inflated and deflated. Since the body of the user can thus be alternately rocked side to side in a manner similar to turning over during sleep, the part of the user's body that is subjected to the body pressure can be periodically changed. As a result, blood circulation of the user is facilitated, and the state of sleep can be satisfactorily maintained without the user turning over. Since turning over of the user can be controlled with a simple structure without using a separate bladder for rocking etc., reduction in weight can be achieved.

In the above aspect, the air bags are configured to be inflated and deflated according to desired distribution rates. The desired distribution rates are desired values of loads applied to the middle support portion, the upper support portion, and the lower support portion of the mat body as expressed in percentage to weight of the user.

According to the above configuration, the air bags disposed in the middle support portion, the upper support portion, and the lower support portion are inflated and deflated according to the desired distribution rates. This can avoid the load due to the weight of the user being concentrated on a part of the support portions, and as a result, can avoid the body pressure being concentrated on a part of the user's body and excessively pressing the part of the user's body. Body pressure dispersion can thus be optimized.

In the above aspect, the air bags may be configured to inflate and deflate according to a shape of a curve of a spine of the user.

According to the above configuration, the air bags are inflated and deflated based on the shape of the curve of the spine of the user. The position and physique of the user on the mat body can be accurately known from, for example, the shape of the curve of the spine, and the air bags can be inflated or deflated accordingly. As a result, the body pressure dispersion can be optimized according to the physique of the user.

In the above aspect, of the air bags, at least the air bag disposed in the middle support portion may be divided into the right bag portion and the left bag portion in the mat width direction, and may be configured in such a manner that, when the user sits in a sideways sitting posture on one side in the mat width direction of the middle support portion, either the right bag portion or the left bag portion that is located on the one side on which the user is sitting is inflated.

According to the above configuration, when the user sits in the sideway sitting posture on the one side in the mat width direction of the middle support portion, either the right bag portion or the left bag portion that is located on the one side on which the user is sitting is inflated. The body pressure of the mat body under the buttocks and thighs of the user is thus increased, and the posture of the user is stabilized. This configuration can thus improve the comfort level when the user sits in the sideways posture on the mat body.

In the above aspect, the mat body may be disposed in a cabin of a vehicle including an entrance and exit at least on one side in a lateral direction of the vehicle in such a manner that the mat width direction matches the lateral direction of the vehicle. At lease the air bag disposed in the middle support portion may be configured in such a manner that, when the user sits in the sideways sitting posture facing the entrance and exit on the one side of the middle support portion, either the right bag portion or the left bag portion that is located on the one side on which the user is sitting is inflated.

According to the above configuration, the mat body is disposed in the cabin of the vehicle in such a manner that the mat length direction matches a longitudinal direction of the vehicle. This vehicle has the entrance and exit on the one side in the mat width direction of the mat body. When the user sits in the sideways sitting posture facing the entrance and exit, either the right bag portion or the left bag portion of the air bag in the middle support portion that is located on the one side on which the user is sitting is inflated. The user can thus switch from sitting on the mat body in the cabin of the vehicle to a stable sideways sitting posture. This allows the user to smoothly get out of the vehicle.

In the above aspect, all the air bags may be divided into the right and left bag portions in the mat width direction.

According to the above configuration, since all the air bags are divided into the right and left bag portions, the body pressures applied from the mat body to the parts from head to lower legs of the user can be finely adjusted.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein:

FIG. 7 illustrates an example of desired distribution rates for the mat body in the bed mode and body pressures applied from the mat body to a user;

FIG. 8 illustrates an example different from the example of FIG. 7, showing desired distribution rates for the mat body in the bed mode and body pressures applied from the mat body to the user;

DETAILED DESCRIPTION OF EMBODIMENTS

Figure 1:
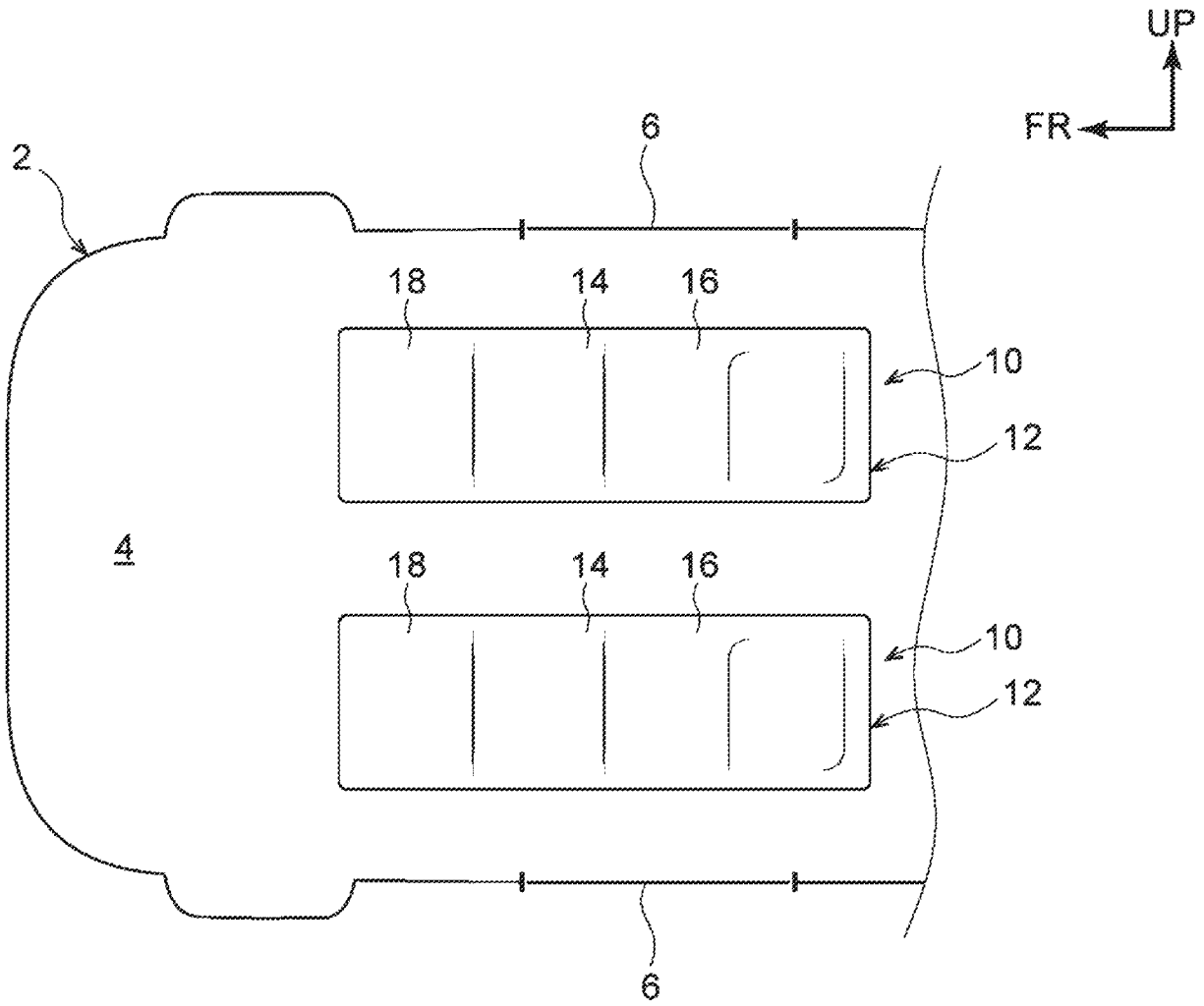
FIG. 1 schematically illustrates a part of a cabin of a vehicle equipped with sleeping equipment according to an embodiment.

Hereinafter, sleeping equipment 10 according to an embodiment will be described with reference to FIGS. 1 to 11. Arrows FR, UP, and RH are shown as needed in the drawings. These arrows FR, UP, and RH indicate the forward direction, upward direction, and right side in the lateral direction of the sleeping equipment 10, respectively. Hereinafter, when description is given by simply using the terms indicating directions, namely front and rear, up and down, and right and left, it means front and rear in the longitudinal direction of the sleeping equipment 10, up and down in the vertical direction of the sleeping equipment 10, and right and left in the lateral direction of the sleeping equipment 10. The forward direction of the sleeping equipment 10 is a direction in the horizontal direction from head toward lower legs of a user who is using the sleeping equipment 10.

Overall Structure

As shown in FIG. 1, the sleeping equipment 10 of the present embodiment is mounted on a vehicle 2. As an example, the vehicle 2 is configured to switch between automatic driving and manual driving. Automatic driving refers to a drive mode of a vehicle in which a part or all of operations of an accelerator pedal, brake pedal, turn signals, steering wheel, etc. are automatically performed. Manual driving refers to a drive mode of a vehicle in which a driver performs all driving operations (operations of the accelerator pedal, brake pedal, turn signals, steering wheel, etc.).

Two pieces of the sleeping equipment 10 are disposed on the right and left sides of a cabin 4 of the vehicle 2, one on each side. In the present embodiment, as an example, the direction a user P faces when seated on the sleeping equipment 10 matches the forward direction of the vehicle 2, and the right and left sides of the user P match the right and left sides in the lateral direction of the vehicle 2.

The vehicle 2 has an entrance and exit 6 on the right side of the vehicle 2. This entrance and exit 6 is located on the right side of the right sleeping equipment 10 in the lateral direction of the vehicle 2 (mat width direction). The vehicle 2 further has an entrance and exit 6 on the left side of the vehicle 2. This entrance and exit 6 is located on the left side of the left sleeping equipment 10 in the lateral direction of the vehicle 2.

Mat Body

Figure 2:
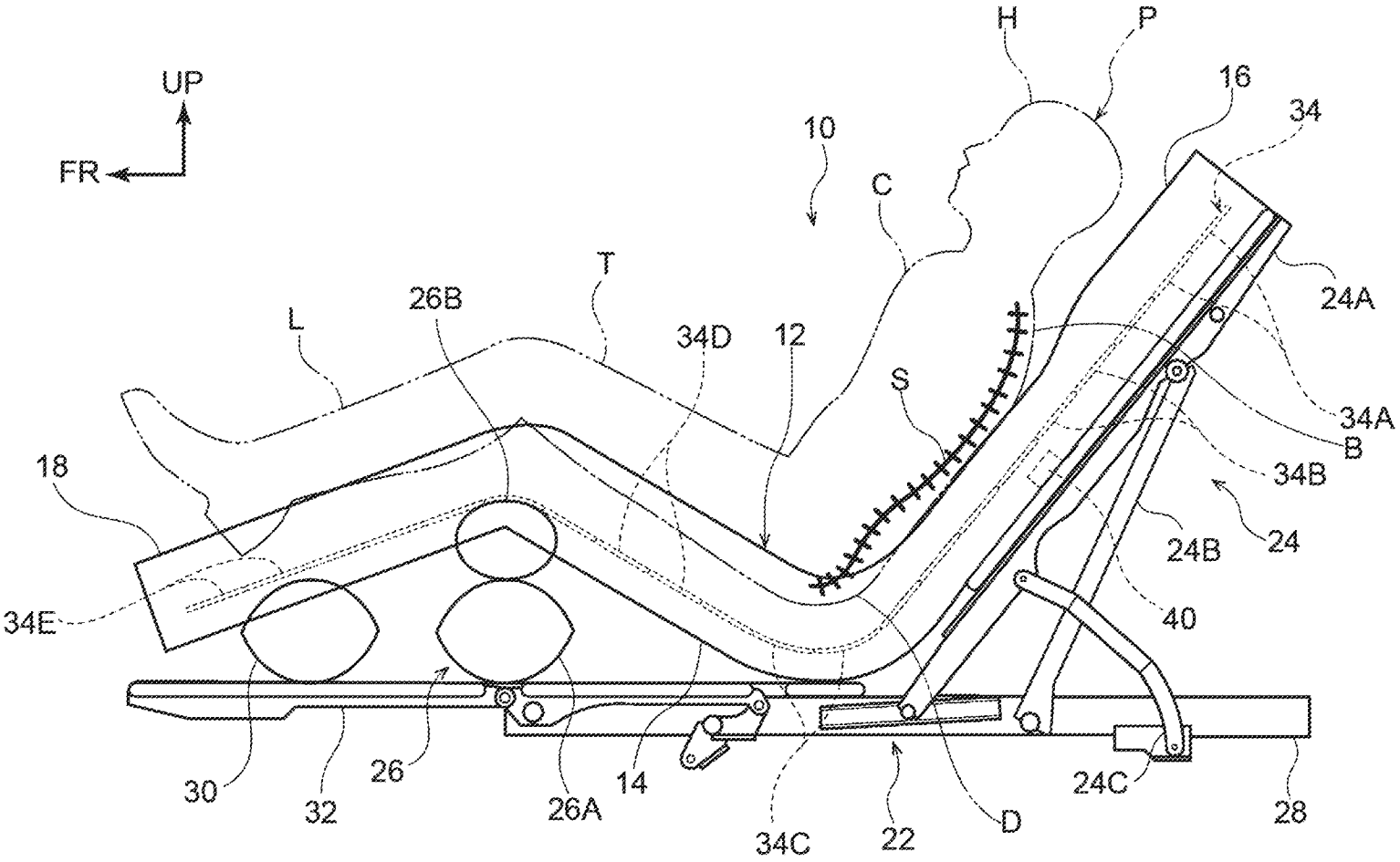
FIG. 2 is a schematic side view of the sleeping equipment according to the embodiment as viewed in the lateral direction of the sleeping equipment, illustrating a chair mode.

As shown in FIG. 2, the sleeping equipment 10 includes a mat body 12. The mat body 12 is disposed in such an attitude that the mat body 12 is long in the longitudinal direction of the vehicle 2. The mat body 12 is configured to switch between a chair mode shown in FIG. 2 and a bed mode shown in FIG. 4. In the chair mode, the mat body 12 can support the user P in a sitting posture. In the bed mode, the mat body 12 can support the user P lying on his or her back on the mat body 12. The user P is a man with an average body type.

The mat body 12 includes a middle support portion 14, an upper support portion 16, and a lower support portion 18. The middle support portion 14 is provided in the middle part in the longitudinal direction of the mat body 12, and is configured to support the buttocks D and thighs T of the user P.

The upper support portion 16 is provided behind the middle support portion 14 continuously with the middle support portion 14. In the bed mode shown in FIG. 4, the upper support portion 16 extends substantially linearly in the horizontal direction. The upper support portion 16 is configured to support the back B and head H of the user P.

The lower support portion 18 is provided in front of the middle support portion 14 continuously with the middle support portion 14. In the bed mode shown in FIG. 4, the lower support portion 18 extends substantially linearly in the horizontal direction. The lower support portion 18 is configured to support the lower legs L of the user P. As described above, in the bed mode, the mat body 12 has a flat shape in which the middle support portion 14, the upper support portion 16, and the lower support portion 18 are continuous with each other.

As shown in FIG. 2, in the chair mode, the middle support portion 14 of the mat body 12 is bent in a substantially V shape with its vertex pointing downward as viewed in the lateral direction. In the chair mode shown in FIG. 2, the upper support portion 16 is tilted with its rear end higher than its front end located on the middle support portion 14 side.

In the chair mode shown in FIG. 2, the lower support portion 18 is tilted with its front end lower than its rear end located at the front end of the middle support portion 14. The front part of the middle support portion 14 and the lower support portion 18 are thus bent in a substantially V shape with its vertex pointing upward as viewed in the lateral direction.

A movable mechanism 22 for switching the mat body 12 between the chair mode and the bed mode is provided below the mat body 12. The movable mechanism 22 includes a link mechanism 24, a lifting bladder 26, and a support base 28.

The support base 28 is a substantially plate-like frame member extending in the horizontal direction such that its thickness direction matches the vertical direction. The support base 28 is placed on a floor panel (sign not shown) of the vehicle 2 and supports the mat body 12 from below. The link mechanism 24 is provided on the rear part of the support base 28. The link mechanism 24 includes a first link 24A, a second link 24B, and a third link 24C.

The first link 24A is attached to the lower surface of the upper support portion 16 of the mat body 12. One end of the first link 24A is rotatably connected to the support base 28. The second link 24B has an elongated shape. One end of the second link 24B is rotatably connected to the rear part of the first link 24A, and the other end of the second link 24B is rotatably connected to the support base 28.

The third link 24C has a substantially arc shape as viewed in the lateral direction. One end of the third link 24C is rotatably connected to the front part of the first link 24A, and the other end of the third link 24C is rotatably connected to the support base 28.

Figure 3:
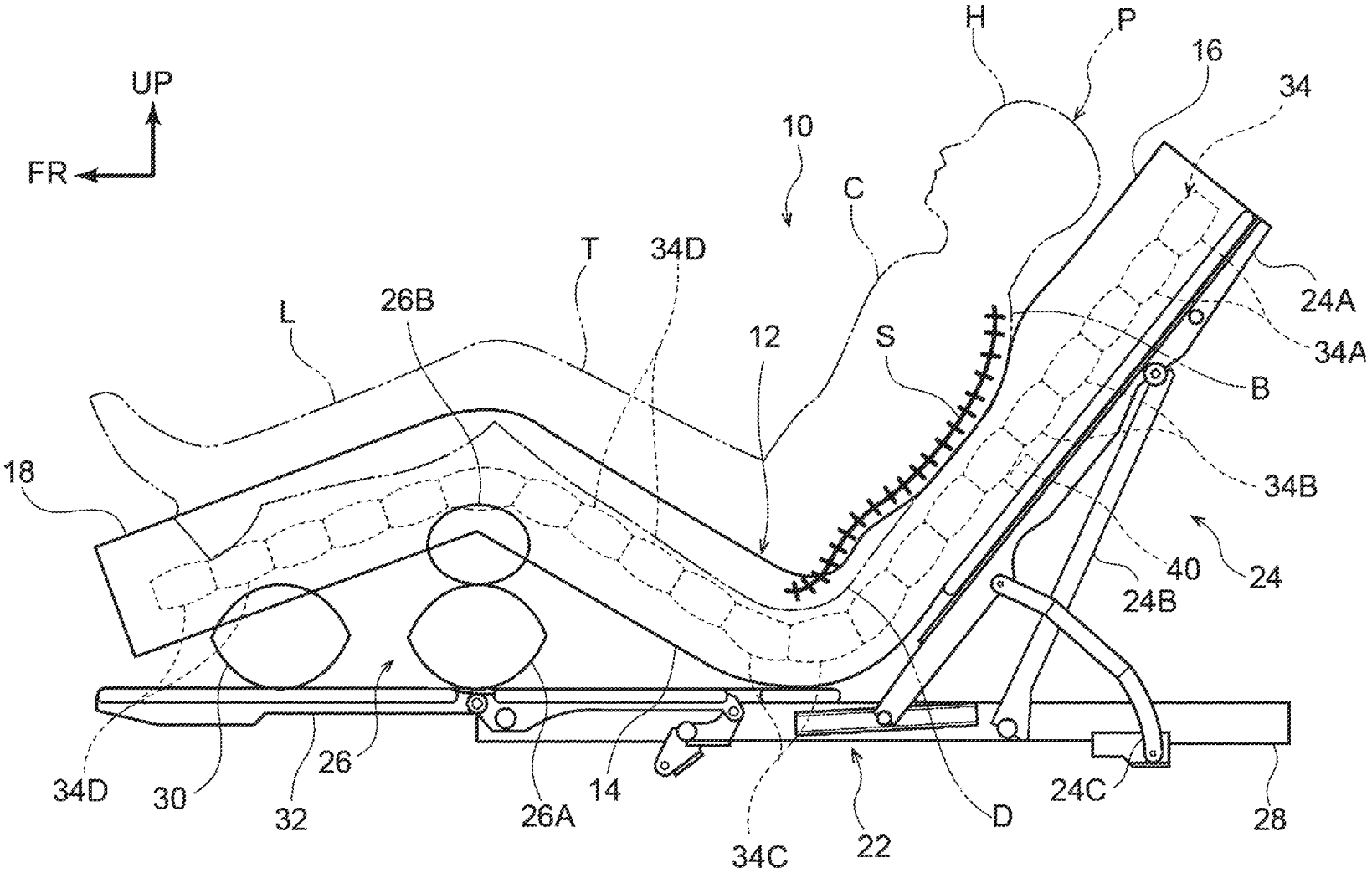
FIG. 3 is a schematic side view of the sleeping equipment with air bags inflated from the state of FIG. 2.
Figure 4:
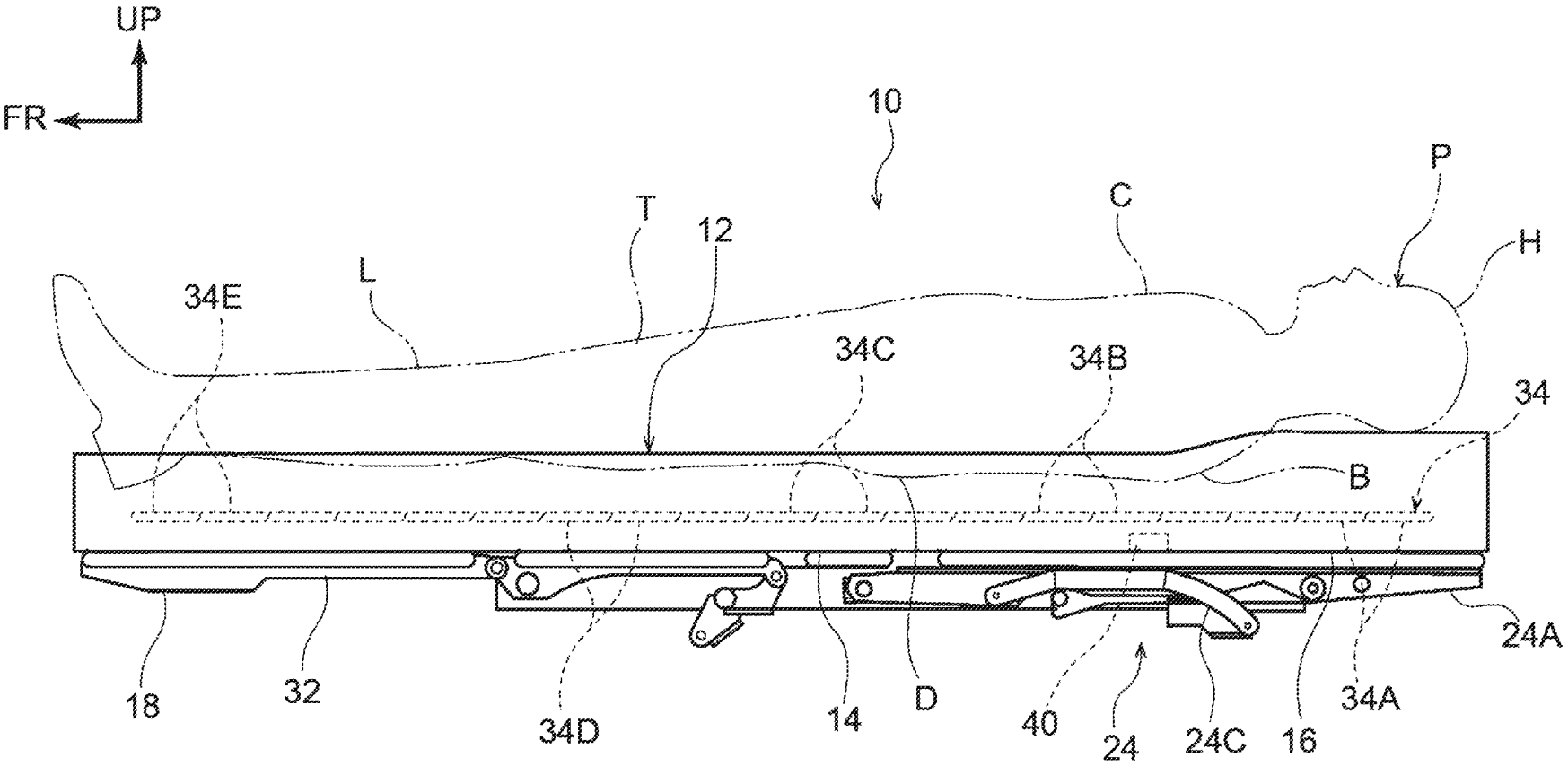
FIG. 4 is a schematic side view of the sleeping equipment according to the embodiment as viewed in the lateral direction of the sleeping equipment, illustrating a bed mode.

A motor, not shown, is provided at the connection portion between the second link 24B and the support base 28. The second link 24B is configured to rotate about its one end when the motor is operated. Although a pair of right and left first links 24A, a pair of right and left second links 24B, and a pair of right and left third links 24C are provided, only the left side is shown in FIGS. 2 to 4.

The lifting bladder 26 includes a lower bladder 26A and an upper bladder 26B. The lower bladder 26A and the upper bladder 26B are arranged between the support base 28 and the mat body 12. Specifically, the lower bladder 26A and the upper bladder 26B are located at the connection portion between the middle support portion 14 and the lower support portion 18 of the mat body 12.

The lower bladder 26A is attached to the support base 28. The upper bladder 26B is attached to the upper surface of the lower bladder 26A, and the internal space of the upper bladder 26B communicates with the internal space of the lower bladder 26A. An air supply unit, not shown, is configured to supply air into the lower bladder 26A. As air is supplied into the lower bladder 26A, the lower bladder 26A and the upper bladder 26B inflate and lift the connection portion between the middle support portion 14 and the lower support portion 18.

A lower leg bladder 30 is provided in front of the lifting bladder 26. The lower leg bladder 30 is attached to a rotating frame 32 that will be described later. The lower leg bladder 30 is configured to inflate as air is supplied into the lower leg bladder 30, and thus support the front part of the lower support portion 18 in a tilted state.

The rotating frame 32 is rotatably attached to the front end of the support base 28. The rotating frame 32 is provided with a lock mechanism, not shown. The rotating frame 32 is locked at a position where the rotating frame 32 is aligned with the support base 28. When unlocked, the rotating frame 32 is rotatable downward with respect to the support base 28. For example, in the case where the floor surface with the support base 28 placed thereon has a step and there is a space under the rotating frame 32, the front end of the rotating frame 32 is located below the support base 28 when the rotating frame 32 is rotated downward. When the lifting bladder 26 and the lower leg bladder 30 are deflated in this state, the lower support portion 18 moves downward and the mat body 12 turns into the shape of a chair.

Support Bladder

Figure 5:
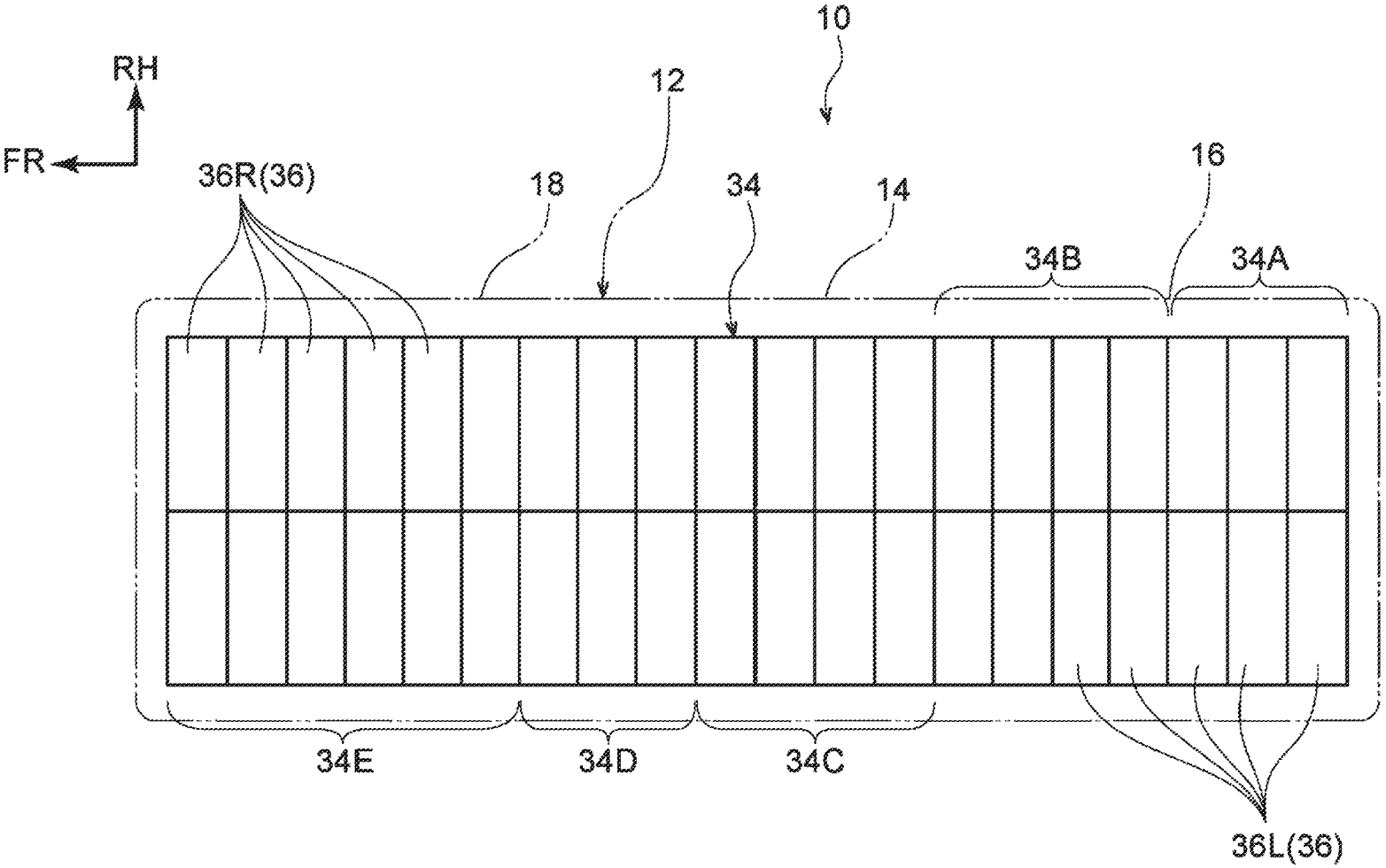
FIG. 5 is a schematic plan view of the sleeping equipment according to the embodiment as viewed from above.

As shown in FIG. 5, a support bladder 34 composed of a plurality of air bags 36 is disposed inside the mat body 12. The support bladder 34 includes a support bladder 34A, a support bladder 34B, a support bladder 34C, a support bladder 34D, and a support bladder 34E. The support bladder 34 is configured to change from a deflated state (no air state) shown in FIG. 2 to an inflated state (air filled state) shown in FIG. 3 as air is supplied from an air supply unit 60, which will be described later, into the air bags 36.

The support bladder 34A is provided in the rear end part of the mat body 12 and is composed of three air bags 36 connected together in the longitudinal direction. These air bags 36 are long in the lateral direction. The support bladder 34A is disposed inside the upper support portion 16 at a position corresponding to the head H of the user P in the sitting posture (see FIG. 2).

The support bladder 34B is provided in front of the support bladder 34A and is composed of four air bags 36 connected together in the longitudinal direction. These air bags 36 are long in the lateral direction. The support bladder 34B is disposed inside the upper support portion 16 at a position corresponding to the back B of the user P in the sitting posture (see FIG. 2).

The support bladder 34C is provided in front of the support bladder 34B and is composed of four air bags 36 connected together in the longitudinal direction. These air bags 36 are long in the lateral direction. The support bladder 34C is disposed inside the middle support portion 14 at a position corresponding to the buttocks D of the user P in the sitting posture (see FIG. 2).

The support bladder 34D is provided in front of the support bladder 34C and is composed of three air bags 36 connected together in the longitudinal direction. These air bags 36 are long in the lateral direction. The support bladder 34D is disposed inside the lower support portion 18 at a position corresponding to the thighs T of the user P in the sitting posture (see FIG. 2).

The support bladder 34E is provided in front of the support bladder 34D and is composed of six air bags 36 connected together in the longitudinal direction. These air bags 36 are long in the lateral direction. The support bladder 34E is disposed inside the lower support portion 18 at a position corresponding to the lower legs L of the user P in the sitting posture (see FIG. 2).

Figure 10:
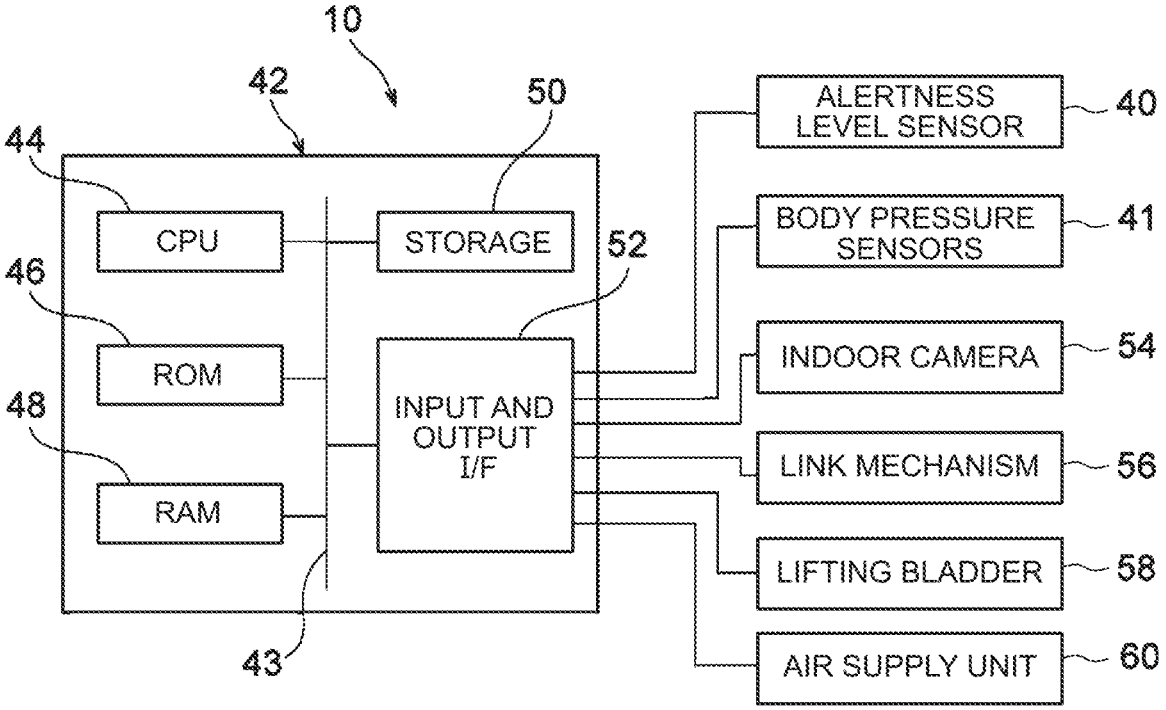
FIG. 10 is a block diagram illustrating a hardware configuration of the sleeping equipment according to the embodiment.

As described above, the support bladder 34 is provided from the front end to rear end of the mat body 12, and is configured to inflate as air is supplied from the air supply unit 60 shown in FIG. 10 into the support bladder 34. The number of air bags 36 of the support bladder 34 is shown by way of example only, and can be changed as needed.

The internal space of each air bag 36 is divided into two. Specifically, each air bag 36 is divided into right and left bag portions 36R, 36L in the mat width direction. Air is supplied from the air supply unit 60 to each of the right and left bag portions 36R, 36L of the air bag 36. This allows the right and left bag portions 36R, 36L to inflate and deflate independently. The mat body 12 changes the cushioning properties and thickness of each part of the mat body 12 by inflating or deflating the air bags 36 of the support bladder 34. The body pressure that is applied from the mat body 12 to each part of the body of the user P can thus be changed. Specifically, when only the right bag portion 36R of the air bag 36 is inflated, the right side of the upper surface of the corresponding part of the mat body 12 is raised, and the thickness of the mat body 12 is increased on this raised side. When only the left bag portion 36L of the air bag 36 is inflated, the left side of the upper surface of the corresponding part of the mat body 12 is raised, and the thickness of the mat body 12 is increased on this raised side. When the right and left bag portions 36R, 36L are inflated at the same time, the upper surface of the entire corresponding part of the mat body 12 is raised, and the overall thickness of the mat body 12 is increased in this raised portion.

By using this divided structure of the air bag 36, the right and left bag portions 36R, 36L of the support bladder 34B in the upper support portion 16 are controlled to operate under a predetermined condition and alternately and repeatedly inflate and deflate.

For example, when the sleeping equipment 10 is in the bed mode, the right bag portions 36R and the left bag portions 36L alternately and repeatedly inflate and deflate on the condition that the user P has fallen asleep. The upper support portion 16 is thus rocked side to side, so that the part of the upper support portion 16 that applies the body pressure to the user P changes periodically. As a result, blood circulation of the user P is facilitated, and the state of sleep can be satisfactorily maintained without the user P turning over.

As shown in FIG. 2, the upper support portion 16 is provided with an alertness level sensor 40. As an example, the alertness level sensor 40 is a known body pressure sensor, and is disposed in the mat body 12 at a position corresponding to the heart of the user P. The alertness level sensor 40 is configured to detect the heartbeat of the user P. The breathing cycle of the user P can be obtained by detecting changes in pressure during breathing of the user P with the alertness level sensor 40.

A plurality of body pressure sensors 41 is provided in the middle support portion 14, the upper support portion 16, and the lower support portion 18 (see FIG. 10). The body pressure sensors 41 are configured to detect the distribution of the load (pressure) input to the entire area of the mat body 12. The body pressure acting on each part of the body of the user P can thus be obtained.

Hardware Configuration of Sleeping Equipment 10

FIG. 10 is a block diagram illustrating a hardware configuration of the sleeping equipment 10. As shown in FIG. 10, the sleeping equipment 10 includes a control unit 42. The control unit 42 includes a central processing unit (CPU) (processor) 44, a read-only memory (ROM) 46, a random access memory (RAM) 48, a storage 50, and an input and output interface 52. These configurations are connected via a bus 43 so that they can communicate with each other.

The CPU 44 is a central processing unit. The CPU 44 executes various programs and controls each unit. That is, the CPU 44 reads a program from the ROM 46 or the storage 50 and executes the program using the RAM 48 as a work area. The CPU 44 controls the above configurations and performs various kinds of arithmetic processing according to the programs stored in the ROM 46 or the storage 50.

The ROM 46 stores various programs and various data. The RAM 48 serves as a work area and temporarily stores a program or data. The storage 50 is a non-transitory recording medium that is composed of a hard disk drive (HDD) or a solid state drive (SSD) and that stores various programs including an operating system and various data. In the present embodiment, the ROM 46 or the storage 50 stores programs for performing a bladder control process, various data, etc.

The input and output interface 52 is electrically connected to the alertness level sensor 40, the body pressure sensors 41, an indoor camera 54, a link mechanism 56, a lifting bladder 58, and the air supply unit 60. The alertness level sensor 40 detects changes in pressure due to the heartbeat and breathing of the user P and sends the detected changes in pressure to the control unit 42. The body pressure sensors 41 detect the distribution of the load input to the mat body 12 from the weight of the user P and sends the detected distribution of the load to the control unit 42.

The indoor camera 54 is mounted in the cabin 4 of the vehicle 2 and is oriented to the user P sitting on the sleeping equipment 10. In the present embodiment, as an example, the indoor camera 54 is configured to capture an image of the face and posture of the user P and send the captured data to the control unit 42.

Functional Configurations of Sleeping Equipment 10

The control unit 42 of the sleeping equipment 10 implements various functions by using the above hardware resources. Functional configurations that are implemented by the sleeping equipment 10 will be described with reference to FIG. 11.

Figure 11:
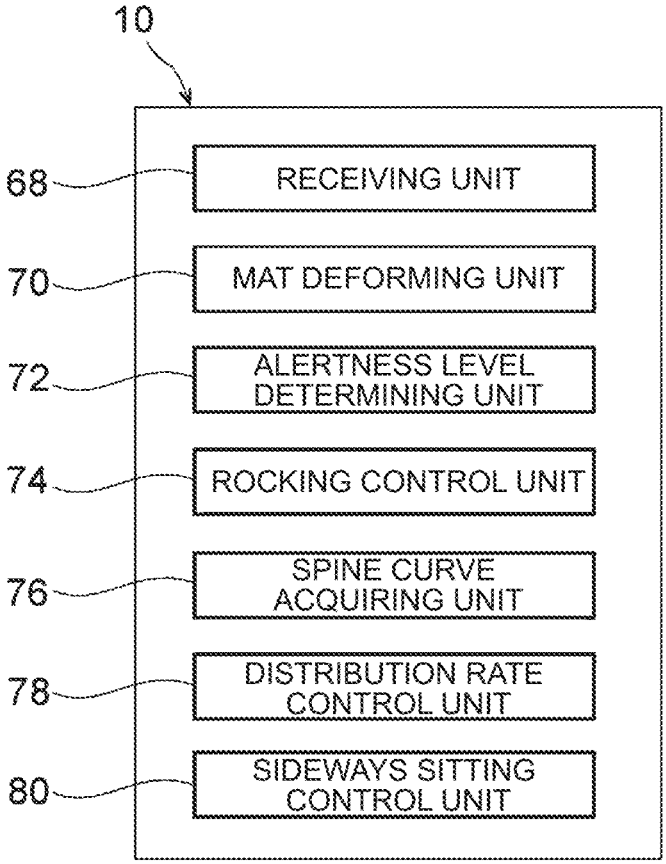
FIG. 11 is a block diagram illustrating functional configurations of the sleeping equipment according to the embodiment.

As shown in FIG. 11, the control unit 42 of the sleeping equipment 10 includes as functional configurations a receiving unit 68, a mat deforming unit 70, an alertness level determining unit 72, a rocking control unit 74, a spine curve acquiring unit 76, a distribution rate control unit 78, and a sideways sitting control unit 80. Each functional configuration is implemented by the CPU 44 reading and executing a program stored in the ROM 46 or the storage 50.

The receiving unit 68 receives signals sent from the alertness level sensor 40, the body pressure sensors 41, the indoor camera 54, etc. The mat deforming unit 70 switches the mat body 12 between the chair mode and the bed mode by operating the movable mechanism 22. For example, the mat deforming unit 70 may operate the movable mechanism 22 by accepting an operation from the user P. Alternatively, the mat deforming unit 70 may switch the mat body 12 from the chair mode to the bed mode by operating the movable mechanism 22 when the user P has fallen asleep. The mat deforming unit 70 may switch the mat body 12 from the bed mode to the chair mode by operating the movable mechanism 22 when the user P has woken up.

The alertness level determining unit 72 determines the alertness level of the user P. Specifically, the alertness level determining unit 72 determines the alertness level of the user P based on the information received from the alertness level sensor 40 and the indoor camera 54. For example, the alertness level determining unit 72 may determine that the user P has fallen asleep when the alertness level determining unit 72 detects from the signal received from the indoor camera 54 that the user P has closed his or her eyes for a predetermined time or longer. The alertness level determining unit 72 may determine that the user P has woken up when he or she has opened his or her eyes from sleep.

The alertness level determining unit 72 may acquire time series data on heart rate variability from the signal received from the alertness level sensor 40, and may determine that the user P is asleep when sympathetic activity and heart rate have decreased based on the acquired time series data on heart rate variability. The alertness level determining unit 72 may determine that the user P is awake when sympathetic activity has increased and parasympathetic activity has decreased. In the present embodiment, the alertness level of the user P is determined based on both the image data of the face and posture of the user P acquired by the indoor camera 54 and the heartbeat data of the user P acquired by the alertness level sensor 40.

The rocking control unit 74 has a function to control the air supply unit 60 to alternately and periodically rock the right and left sides of the upper support portion 16 when the alertness level determining unit 72 determines that the user P has fallen asleep. Specifically, as shown in FIG. 6A, in the state immediately before the rocking control unit 74 starts rocking the upper support portion 16, no air has been supplied to the right and left bag portions 36R, 36L of the air bags 36 of the support bladder 34B disposed inside the upper support portion 16.

Figure 6A:
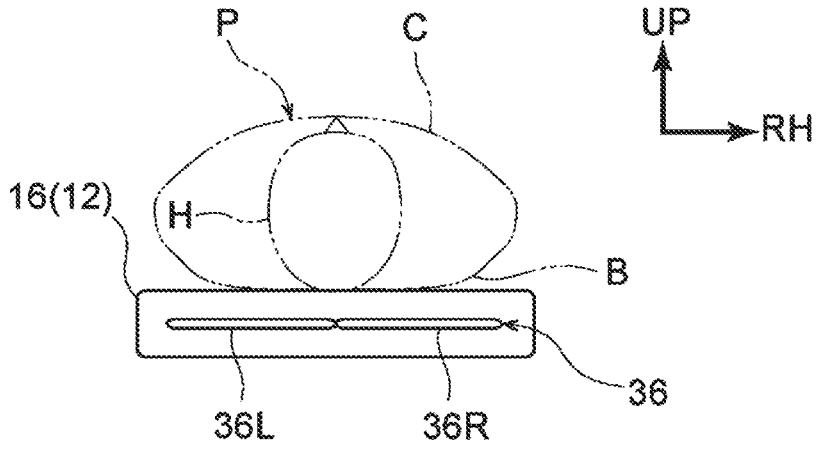
FIG. 6A illustrates the sleeping equipment according to the embodiment as viewed from the rear in the longitudinal direction of the sleeping equipment, illustrating a mat body with its upper surface being horizontal.
Figure 6B:
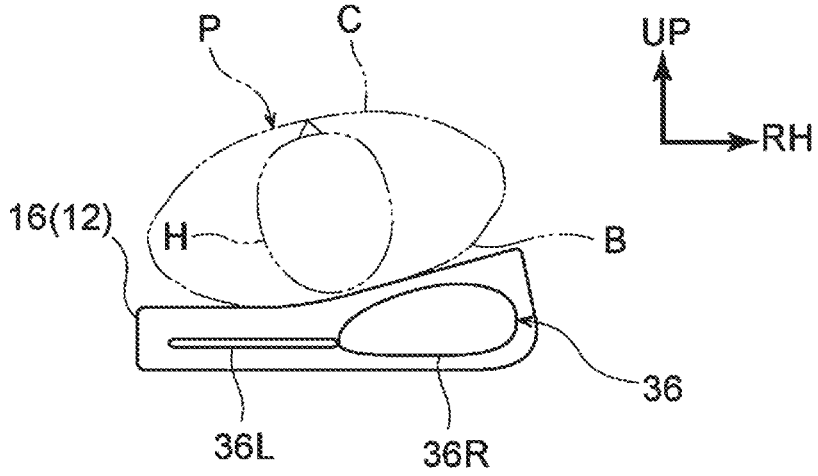
FIG. 6B illustrates the sleeping equipment according to the embodiment as viewed from the rear in the longitudinal direction of the sleeping equipment, illustrating the mat body with its upper surface tilted to the left.
Figure 6C:
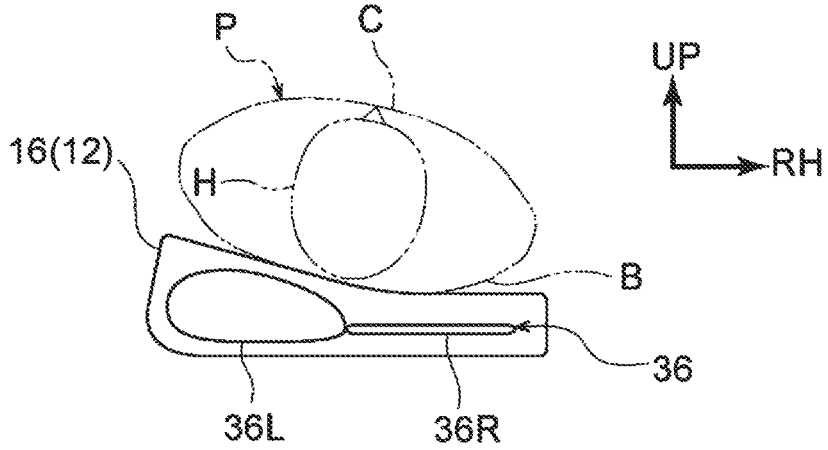
FIG. 6C illustrates the sleeping equipment according to the embodiment as viewed from the rear in the longitudinal direction of the sleeping equipment, illustrating the mat body with its upper surface tilted to the right.

The rocking control unit 74 starts supplying air from the air supply unit 60 to the right bag portions 36R of the air bags 36 from the state of FIG. 6A. As shown in FIG. 6B, after supplying air from the air supply unit 60 until the right bag portions 36R have a predetermined air pressure, the rocking control unit 74 keeps the air pressure constant for a predetermined time. At this time, the right side of the upper surface of the upper support portion 16 is raised and tilted as viewed in the longitudinal direction, and the body of the user P is tilted to the left.

The rocking control unit 74 then stops supplying air into the right bag portions 36R from the state of FIG. 6B and starts supplying air to the left bag portions 36L. As a result, the right bag portions 36R deflate, while the left bag portions 36L inflate to the state of FIG. 6C. The rocking control unit 74 then keeps the air pressure constant for a predetermined time in the state of FIG. 6C. At this time, the left side of the upper surface of the upper support portion 16 is raised and tilted as viewed in the longitudinal direction, and the body of the user P is tilted to the right. As an example, the rocking control unit 74 of the present embodiment controls the air supply unit 60 so as to alternately switch the upper support portion 16 between the state of FIG. 6B and the state of FIG. 6C about every 90 minutes.

The spine curve acquiring unit 76 acquires the position of the spine (backbone) S and the shape of the curve of the spine S of the user P sitting or lying on the mat body 12 (see FIGS. 2 and 3). For example, when the spine curve acquiring unit 76 determines that the user P is sitting or lying on the mat body 12, the spine curve acquiring unit 76 inflates the support bladders 34A, 34B based on the signals from the body pressure sensors 41 so that the upper support portion 16 applies a predetermined body pressure to the user P, The spine curve acquiring unit 76 then acquires the position of the spine S or the shape of the curve of the spine S of the user P based on the raised amount of the upper surface of the mat body 12 (inflated amount of the air bags 36).

The distribution rate control unit 78 has a function to acquire the positions of the head H, chest C, buttocks D, and lower legs (portions below the knees) L of the user P based on the signals from the body pressure sensors 41. For the buttocks D and the chest C, accurate positions are calculated according to the position and curve of the spine S acquired by the spine curve acquiring unit 76.

The distribution rate control unit 78 acquires the loads input from the head H, chest C, buttocks D, and lower legs L of the user P to the mat body 12 based on the signals from the body pressure sensors 41. The term "load" input from the user P to the mat body 12 is interchangeable with the term "body pressure" applied from the mat body 12 to the user P.

The distribution rate control unit 78 also calculates the proportion of the load applied from each part of the body of the user P to the mat body 12 to the overall load applied from the user P to the mat body 12, based on the loads input from the head H, chest C, buttocks D, and lower legs L to the mat body 12. The distribution rate control unit 78 then controls inflation and deflation of the air bags 36 in the middle support portion 14, the upper support portion 16, and the lower support portion 18 according to preset desired distribution rates.

The desired distribution rates refer to the desired values of the loads applied to the middle support portion 14, upper support portion 16, and lower support portion 18 of the mat body 12 as expressed in percentage to the weight of the user P. In the present embodiment, as an example, the desired distribution rates are set for the parts of the mat body 12 corresponding to the head H, chest C, buttocks D, and lower legs L of the user P in the middle support portion 14, the upper support portion 16, and the lower support portion 18.

This will be described in more detail. Different parts of the human body have different weights. Accordingly, when the user spends time on the mat body 12, the body pressure applied from the mat body 12 to each part of the body varies depending on the weight of the part. For example, since the buttocks D are typically the heaviest part of the body, the body pressure applied from the mat body 12 to the buttocks D is the highest. However, if the body pressure applied to the body of the user P is too high, the part of the body subjected to the body pressure is firmly pressed. This reduces the comfort level. Accordingly, in the part of the mat body 12 that applies a high body pressure, the air bags 36 are inflated or deflated so as to improve the cushioning properties of the mat body 12. The body pressure applied to the user P is thus dispersed. This can avoid the body pressure being excessively concentrated on a part of the body. The comfort level of the user P can therefore be maintained.

The desired distribution rates are set based on the above idea. The body pressure applied to the user P can be dispersed in a balanced manner by distributing the load input from the user P to the mat body 12 according to the desired distribution rates. In the present embodiment, the distribution rates of the loads input from the head H, chest C, buttocks D, and lower legs L of the user P to the mat body 12 are acquired for the state in which the corresponding air bags 36 are inflated (air filled state) and the state in which the corresponding air bags 36 are deflated (no air state). The load distribution rate for each part is compared between the air filled state and the no air state, and is set to a value close to the desired distribution rate for that part.

Hereinafter, the control that is performed by the distribution rate control unit 78 when two users P having different physiques use the mat body 12 in the bed mode will be specifically described with reference to FIGS. 7 and 8.

As shown in FIGS. 7 and 8, the desired distribution rates in the bed mode are set to, for example, 8% for the head, 33% for the chest, 44% for the buttocks, and 15% for the lower legs. In the case where the first user P shown in FIG. 7 uses the mat body 12, the distribution rate for the head H is 9.1% in the no air state and 5.5% in the air filled state. The distribution rate in the no air state is closer to the desired distribution rate than the distribution rate in the air filled state is. Accordingly, the distribution rate control unit 78 deflates the air bags 36 corresponding to the head H to the no air state.

The distribution rate for the chest C is 35.7% in the no air state and 38.9% in the air filled state. The distribution rate in the no air state is closer to the desired distribution rate than the distribution rate in the air filled state is. Accordingly, the distribution rate control unit 78 deflates the air bags 36 corresponding to the chest C to the no air state.

The distribution rate for the buttocks D is 41.1% in the no air state and 42.8% in the air filled state. The distribution rate in the air filled state is closer to the desired distribution rate than the distribution rate in the no air state is. Accordingly, the distribution rate control unit 78 inflates the air bags 36 corresponding to the buttocks D to the air filled state.

The distribution rate for the lower legs L is 16.9% in the no air state and 12.9% in the air filled state. The distribution rate in the no air state is closer to the desired distribution rate than the distribution rate in the air filled state is. Accordingly, the distribution rate control unit 78 deflates the air bags 36 corresponding to the lower legs L to the no air state.

In the case where the second user P shown in FIG. 8 uses the mat body 12, the distribution rate for the head H is 5.8% in the no air state and 4.1% in the air filled state. The distribution rate in the no air state is closer to the desired distribution rate than the distribution rate in the air filled state is. Accordingly, the distribution rate control unit 78 deflates the air bags 36 corresponding to the head H to the no air state.

The distribution rate for the chest C is 37.7% in the no air state and 43.1% in the air filled state. The distribution rate in the no air state is closer to the desired distribution rate than the distribution rate in the air filled state is. Accordingly, the distribution rate control unit 78 deflates the air bags 36 corresponding to the chest C to the no air state.

The distribution rate for the buttocks D is 47.7% in the no air state and 41.4% in the air filled state. The distribution rate in the air filled state is closer to the desired distribution rate than the distribution rate in the no air state is. Accordingly, the distribution rate control unit 78 inflates the air bags 36 corresponding to the buttocks D to the air filled state.

The distribution rate for the lower legs L is 8.8% in the no air state and 11.3% in the air filled state. The distribution rate in the air filled state is closer to the desired distribution rate than the distribution rate in the no air state is. Accordingly, the distribution rate control unit 78 inflates the air bags 36 corresponding to the lower legs L to the air filled state.

As described above, the distribution rate control unit 78 has a function to effectively disperse the body pressure by inflating or deflating the corresponding air bags 36 of the mat body 12 according to the desired distribution rates and thus adjusting the body pressure applied from each part of the mat body 12 according to the physique of the user P.

In the example of FIGS. 7 and 8, only the desired distribution rates for the mat body 12 that is in the bed mode are described. However, the corresponding desired distribution rates are also set in advance for the mat body 12 that is in the chair mode.

The sideways sitting control unit 80 has the following function. When an occupant is sitting in a sideways sitting posture on the middle support portion 14 of the mat body 12, the sideways sitting control unit 80 controls the air supply unit 60 to increase the body pressure applied from one side in the mat width direction of the middle support portion 14 on which the user P is sitting. Specifically, the sideways sitting control unit 80 determines whether the user P is sitting in a sideways sitting posture facing the entrance and exit 6 of the vehicle 2, based on the image data of the sitting posture of the user P acquired by the indoor camera 54.

The sideways sitting control unit 80 may acquire the load input to the mat body 12 from the signals of the body pressure sensors 41, and may determine based on the acquired load data that the user P is sitting in a sideway sitting posture when the load is being input only to one side in the mat width direction of the middle support portion 14 facing the entrance and exit 6. In the present embodiment, whether the user P is sitting in the sideways sitting posture facing the entrance and exit 6 of the vehicle 2 is determined based on both the image data of the sitting posture of the user P acquired by the indoor camera 54 and the data of the load input from the user P to the mat body acquired by the body pressure sensors 41.

Figure 9A:
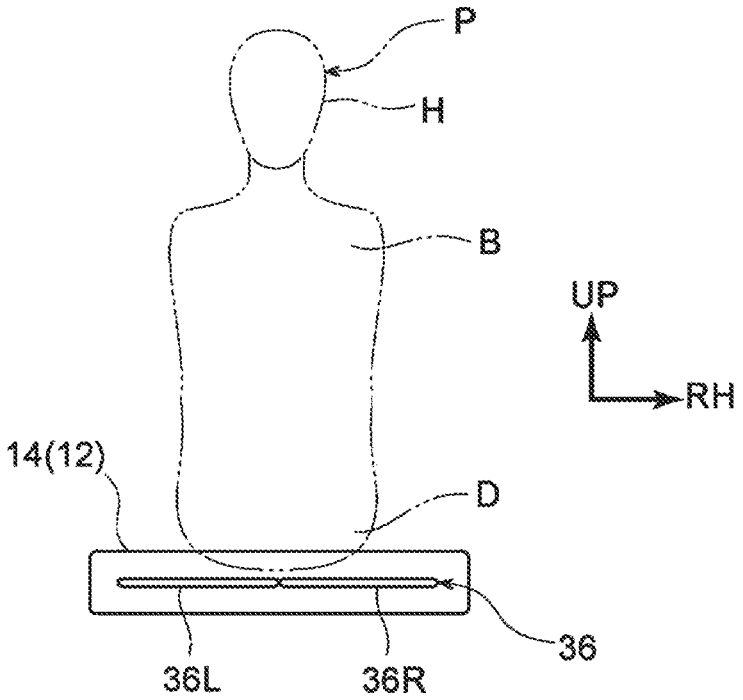
FIG. 9A illustrates a middle support portion of the sleeping equipment according to the embodiment as viewed from the rear in the longitudinal direction of the sleeping equipment, illustrating the user sitting in a forward facing posture.
Figure 9B:
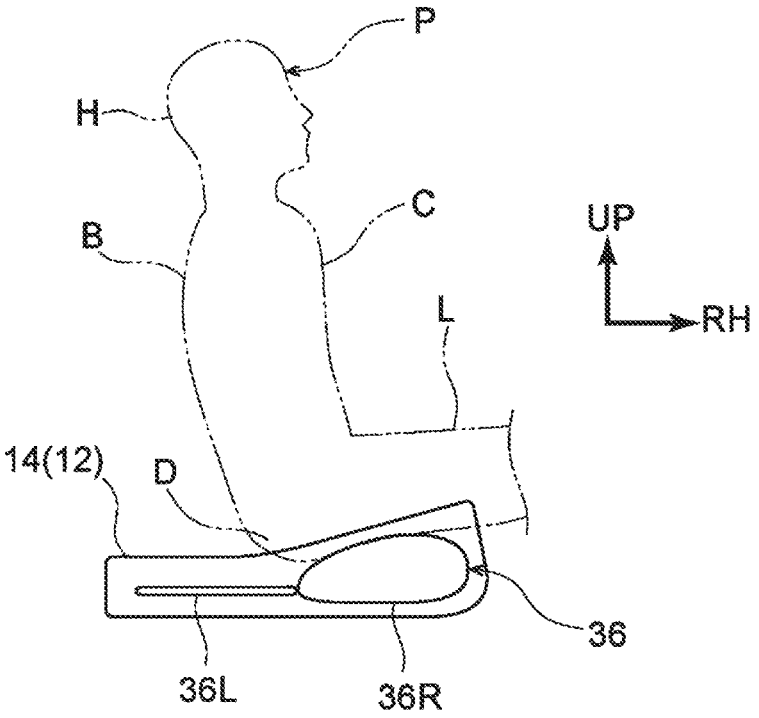
FIG. 9B illustrates the middle support portion of the sleeping equipment according to the embodiment as viewed from the rear in the longitudinal direction of the sleeping equipment, illustrating the user sitting sideways.

When the sideways sitting control unit 80 determines that the user P is sitting in the sideways sitting posture, the sideways sitting control unit 80 inflates only one side in the mat width direction of the support bladder 34C inside the middle support portion 14 on which the user P is sitting. An example will be described in which the user switches from sitting on the mat body 12 in the chair mode in a posture facing forward as shown in FIG. 9A to sitting in a sideways sitting posture facing to the right and facing the entrance and exit 6 as shown in FIG. 9B. In this case, the sideways sitting control unit 80 stops supplying air into the left bag portions 36L of the air bags 36 of the support bladder 34C and starts supplying air to the right bag portions 36R of the air bags 36 of the support bladder 34C. As a result, the left bag portions 36L deflate, while the right bag portions 36R inflate to the state of FIG. 9B. The air pressure is kept constant while the user P is sitting sideways in the state of FIG. 9B. At this time, the cushioning properties on the right side in the mat width direction of the middle support portion 14 are reduced, and the body pressure applied to the buttocks D of the user P is increased. As a result, the buttocks D are stably supported, so that the user P can stabilize his or her posture even when sitting sideways. Moreover, the user P can smoothly stand up when getting out of the vehicle 2 through the entrance and exit 6.

Functions and Effects

Functions and effects of the present embodiment will be described.

In the sleeping equipment 10 of the present embodiment, the mat body 12 includes the middle support portion 14, the upper support portion 16, and the lower support portion 18. The mat body 12 is configured to switch between the bed mode and the chair mode. In the bed mode, the mat body 12 supports the user P lying on his or her back on the mat body 12. In the chair mode, the mat body 12 supports the user P sitting on the mat body 12. The user P can thus switch from the sleeping posture to the sitting posture by switching the mode of the mat body 12.

The air bags 36 are arranged in the mat body 12 in a mat length direction from the upper support portion 16 toward the lower support portion 18. These air bags 36 are in the shape of an elongated bag that is long in the mat width direction, and can be inflated or deflated to disperse the body pressure applied from the mat body 12 to the user P. Each of these air bags 36 is divided into the right and left bag portions 36R, 36L in the mat width direction, and the right and left bag portions 36R, 36L can be inflated and deflated independently. Accordingly, even when the user P is in a posture biased toward one side in the mat width direction of the mat body 12, the body pressures applied from the mat body 12 to the right and left sides of the body of the user P can be adjusted by adjusting the right and left bag portions 36R, 36L of the air bags 36 independently. As a result, the body pressure dispersion effect can be enhanced even when the user P is in such a posture that the body pressure is different between the right and left sides of the body.

Since all the air bags are divided into the right and left bag portions, the body pressures applied from the mat body 12 to the parts from head H to lower legs L of the user P can be adjusted.

In the present embodiment, the right and left bag portions 36R, 36L of the air bags 36 in the upper support portion 16 can be alternately inflated and deflated. Since the body of the user P can thus be alternately rocked side to side in a manner similar to turning over during sleep, the part of the body of the user P that is subjected to the body pressure can be periodically changed. As a result, blood circulation of the user P is facilitated, and the state of sleep can be satisfactorily maintained without the user P turning over. Since turning over of the user P can be controlled with a simple structure without using a separate bladder for rocking etc., reduction in weight can be achieved.

In the present embodiment, the air bags 36 disposed in the middle support portion 14, the upper support portion 16, and the lower support portion 18 are inflated and deflated according to the desired distribution rates. Specifically, the air bags 36 corresponding to the head H, chest C, buttocks D, and lower legs L of the user P are inflated and deflated. This can avoid the load due to the weight of the user P being concentrated on a part of the support portions, and as a result, can avoid the body pressure being concentrated on a part of the body of the user P and excessively pressing the part of the body of the user P. Body pressure dispersion can thus be optimized.

In the present embodiment, the air bags 36 are inflated or deflated according to the shape of the curve of the spine S of the user P. The position and physique of the user P on the mat body 12 can be accurately known from the shape of the curve of the spine S, and the air bags 36 can be inflated or deflated accordingly. As a result, the body pressure dispersion can be optimized according to the physique of the user.

In the present embodiment, when the user P sits in a sideways posture on one side in the mat width direction of the middle support portion 14, either the right bag portions 36R or the left bag portions 36L of the air bags 36 that are located on the one side on which the user P is sitting are inflated. The body pressure of the mat body 12 under the buttocks D and thighs T of the user P is thus increased, and the posture of the user P is stabilized. This configuration can thus improve the comfort level when the user P sits in the sideways posture on the mat body 12.

In the present embodiment, when the user P sits sideways facing the entrance and exit 6 on the middle support portion 14, either the right bag portions 36R or the left bag portions 36L that are located on the one side on which the user P is sitting are inflated according to the function of the sideways sitting control unit 80. The user P can thus switch from sitting on the mat body 12 in the cabin 4 of the vehicle 2 to a stable sideways sitting posture. This allows the user P to smoothly get out of the vehicle 2. Even when the user P gets into the vehicle 2 through the entrance and exit 6, the user P can smoothly switch from sitting sideways on the middle support portion 14 to a sitting posture facing forward.

Supplementary Explanation

In the present embodiment, the sleeping equipment 10 is disposed in the cabin 4 of the vehicle 2. However, the installation location of the sleeping equipment 10 is not limited.

In the above embodiment, all the air bags 36 of the support bladder 34 are configured to have a divided structure. Namely, all the air bags 36 of the support bladder 34 have the right and left bag portions 36R, 36L. However, the present disclosure is not limited to this. A part of the support bladder 34 may have the right and left bag portions 36R, 36L.

In the above embodiment, in order to make the load distribution rates for the mat body 12 closer to the desired distribution rates, either the air filled state or the no air state is selected for the corresponding air bags 36. However, the present disclosure is not limited to this. The load distribution rates for the mat body 12 may be made closer to the desired distribution rates by changing the amount of air supplied to the air bags 36 as appropriate and thus adjusting the air pressures of the air bags 36.

In the above embodiment, only the upper support portion 16 is periodically rocked by the function of the rocking control unit 74. However, the present disclosure is not limited to this. The middle support portion 14 and the lower support portion 18 may also be configured to be rocked as necessary in a manner similar to the upper support portion 16 by inflating or deflating the corresponding air bags 36. In this case, the user's body may be stretched by tilting the upper and lower bodies of the user in different directions. For example, when the right side of the upper surface of the upper support portion 16 is raised, the left side of the upper surface of the lower support portion 18 may be raised.

In the above embodiment, the shape of the curve of the spine S is acquired when the user P sits or lies on the mat body 12. However, the shape of the curve of the spine S of the user P may be stored in advance in the ROM 46 or storage 50 of the sleeping equipment 10, and the air bags 36 may be inflated or deflated based on the stored shape of the curve of the spine S. The shape of the curve of the spine S may be stored in an external server, and the sleeping equipment 10 receives the shape of the curve of the spine S from the external server via communication means.

In the above embodiment, when it is determined that the user P is sitting sideways facing the entrance and exit 6 of the vehicle 2 based on the function of the sideways sitting control unit 80, the air bags 36 below the buttocks D are inflated. However, the present disclosure is not limited to this. The air bags 36 located below the buttocks D may be inflated when the user P sits sideways facing the entrance and exit 6 in conjunction with opening and closing of a door for the entrance and exit 6 or unlocking and locking of a lock mechanism for the door. Specifically, for example, a door sensor for detecting unlocking or locking of the lock mechanism is electrically connected to the input and output interface 52 of the sleeping equipment 10. The air bags 36 located below the buttocks D are inflated when unlocking of the door for the entrance and exit 6 is detected according to a signal from the door sensor and the user P sits sideways facing the entrance and exit 6. This configuration also has similar effects to the above embodiment. Since the corresponding air bags 36 are inflated on the condition that the door is opened (the lock mechanism is unlocked), the user P can stabilize his or her sideways sitting posture more quickly.

What is claimed is:

1. Sleeping equipment, comprising:

a mat body including a middle support portion configured to support buttocks and thighs of a user, an upper support portion configured to support a back and head of the user, and a lower support portion configured to support lower legs of the user, the mat body being configured to switch between a bed mode and a chair mode, the bed mode being a mode in which the mat body supports the user lying on a user's back on the mat body, and the chair mode being a mode in which the mat body supports the user sitting on the mat body;

a plurality of air bags arranged in the mat body in a mat length direction from the upper support portion toward the lower support portion, each of the plurality of air bags being in an elongated shape that is long in a mat width direction;

a bladder disposed below the mat body; and one or more sensors configured to determine a status of the user, wherein at least a part of the plurality of air bags is divided into right and left bag portions in the mat width direction, and the right bag portion and the left bag portion are configured to be independently inflated and deflated, the bladder is configured to be inflated in response to the mat body being switched from the bed mode to the chair mode, the mat body is configured to switch between the bed mode and the chair mode in response to a signal from the one or more sensors, the one or more sensors include a camera or a body pressure sensor configured to determine whether the user is sitting in a sideways sitting posture, the plurality of air bags is configured to be inflated in response to a signal indicating that the user is sitting in the sideways sitting posture from the camera or the body pressure sensor, the mat body is configured to be disposed in a cabin of a vehicle including an entrance and exit, and the plurality of air bags is configured to be inflated in response to the user sitting sideways facing the entrance and exit in conjunction with (i) opening and closing of a door for the entrance and exit or (ii) unlocking and locking a lock mechanism for the door.

2. The sleeping equipment according to claim 1, wherein in at least the part of the plurality of air bags, the right bag portion and the left bag portion are configured to be alternately inflated and deflated.

3. The sleeping equipment according to claim 1, wherein the plurality of air bags is configured to be inflated and deflated according to desired distribution rates, the desired distribution rates being desired values of loads applied to the middle support portion, the upper support portion, and the lower support portion of the mat body as expressed in percentage to weight of the user.

4. The sleeping equipment according to claim 1, wherein the plurality of air bags is configured to inflate and deflate according to a shape of a curve of a spine of the user.

5. The sleeping equipment according to claim 1, wherein the plurality of air bags includes a first air bag disposed in the middle support portion and divided into a first right bag portion and a second left bag portion in the mat width direction, and the first air bag is configured in such a manner that, when the user sits in a sideways sitting posture on one side in the mat width direction of the middle support portion, either the first right bag portion or the first left bag portion that is located on the one side on which the user is sitting is inflated.

6. The sleeping equipment according to claim 5, wherein the mat body is configured to be disposed in a cabin of a vehicle including an entrance and exit at least on one side in a lateral direction of the vehicle in such a manner that the mat width direction matches the lateral direction of the vehicle, and at least the first air bag disposed in the middle support portion is configured in such a manner that, when the user sits in the sideways sitting posture facing the entrance and exit on the one side of the middle support portion, either the first right bag portion or the first left bag portion that is located on the one side on which the user is sitting is inflated.

7. The sleeping equipment according to claim 1, wherein all the plurality of air bags are divided into the right and left bag portions in the mat width direction.

8. The sleeping equipment according to claim 1, wherein the right and left bag portions of one of the plurality of air bags are in direct contact with the corresponding right and left bag portions of another one of the plurality of air bags adjacent to said one of the plurality of air bags in the mat length direction.

9. The sleeping equipment according to claim 1, wherein the one or more sensors include an alertness level sensor disposed in the mat body and configured to determine a heartbeat of the user, and the mat body is configured to switch between the bed mode and the chair mode in response to a signal indicating the heartbeat of the user from the alertness level sensor.

10. The sleeping equipment according to claim 1, further comprising a processor configured to control inflation and deflation of the right and left bag portions, wherein the one or more sensors include an alertness level sensor disposed in the mat body and configured to determine a heartbeat of the user, and the processor is configured to determine that the user has fallen asleep based on the heartbeat of the user, and in response to the mat body being in the bed mode and the user having fallen asleep, cause the right and left bag portions alternately and repeatedly inflate and deflate.

11. Sleeping equipment, comprising:

a mat body including a middle support portion configured to support buttocks and thighs of a user, an upper support portion configured to support a back and head of the user, and a lower support portion configured to support lower legs of the user, the mat body being configured to switch between a bed mode and a chair mode, the bed mode being a mode in which the mat body supports the user lying on a user's back on the mat body, and the chair mode being a mode in which the mat body supports the user sitting on the mat body;

a plurality of air bags arranged in the mat body in a mat length direction from the upper support portion toward the lower support portion, each of the plurality of air bags being in an elongated shape that is long in a mat width direction;

a bladder disposed below the mat body; and one or more sensors configured to determine a status of the user, wherein at least a part of the plurality of air bags is divided into right and left bag portions in the mat width direction, and the right bag portion and the left bag portion are configured to be independently inflated and deflated, the bladder is configured to be inflated in response to the mat body being switched from the bed mode to the chair mode, the mat body is configured to switch between the bed mode and the chair mode in response to a signal from the one or more sensors, the one or more sensors include a camera or a body pressure sensor configured to determine whether the user is sitting in a sideways sitting posture; and an alertness level sensor disposed in the mat body and configured to determine a heartbeat of the user, the plurality of air bags is configured to be inflated in response to a signal indicating that the user is sitting in the sideways sitting posture from the camera or the body pressure sensor, the mat body is configured to be disposed in a cabin of a vehicle including an entrance and exit, the plurality of air bags is configured to be inflated in response to the user sitting sideways facing the entrance and exit in conjunction with (i) opening and closing of a door for the entrance and exit or (ii) unlocking and locking a lock mechanism for the door, and the mat body is configured to switch between the bed mode and the chair mode in response to a signal indicating the heartbeat of the user from the alertness level sensor.

* * * * *